US007258242B2

(12) United States Patent
Irsch et al.

(10) Patent No.: US 7,258,242 B2
(45) Date of Patent: Aug. 21, 2007

(54) MOBILE CRANE BOOM HAVING AN AUTARCHIC HYDRAULIC POWER UNIT MOUNTED THEREON

(75) Inventors: Michael Irsch, Lebach (DE); Bernd Backes, Oberthal (DE)

(73) Assignee: Terex-Demag GmbH & Co. KG, Zweibrucken (DE)

( * ) Notice: Subject to any disclaimer, the term of this patent is extended or adjusted under 35 U.S.C. 154(b) by 0 days.

(21) Appl. No.: 10/922,373

(22) Filed: Aug. 20, 2004

(65) Prior Publication Data

US 2005/0098524 A1 May 12, 2005

Related U.S. Application Data

(60) Provisional application No. 60/497,107, filed on Aug. 22, 2003.

(51) Int. Cl.
*B66C 23/06* (2006.01)

(52) U.S. Cl. ..... 212/300; 212/168; 212/238; 212/261

(58) Field of Classification Search ..... 212/300, 212/168, 238, 261
See application file for complete search history.

(56) References Cited

U.S. PATENT DOCUMENTS

| | | | | |
|---|---|---|---|---|
| 1,690,181 | A * | 11/1928 | Sederholm | 60/474 |
| 2,188,672 | A * | 1/1940 | Atkinson | 37/186 |
| 2,212,236 | A * | 8/1940 | Hoenecke | 37/318 |
| 3,061,122 | A * | 10/1962 | Robbins | 414/687 |
| 3,608,742 | A * | 9/1971 | Adolfsson | 212/285 |
| 3,653,193 | A * | 4/1972 | Coughran, Jr. | 56/10.7 |
| 3,817,397 | A * | 6/1974 | Wellman | 212/296 |
| 3,934,729 | A | 1/1976 | Wellman | |
| 3,938,670 | A | 2/1976 | Wellman | |
| 3,939,988 | A | 2/1976 | Wellman | |
| 3,944,081 | A | 3/1976 | Wellman | |
| 4,076,215 | A * | 2/1978 | Landert et al. | 254/93 R |
| 4,193,733 | A * | 3/1980 | Ullmann | 414/694 |
| 4,334,668 | A * | 6/1982 | Caris | 254/8 B |

(Continued)

FOREIGN PATENT DOCUMENTS

DE 3411051 A1 9/1985

(Continued)

OTHER PUBLICATIONS

"International Search Report, Application No. PCT/EP2004/009367, date mailed Dec. 21, 2004", 3 Pages.

*Primary Examiner*—Thomas J. Brahan
(74) *Attorney, Agent, or Firm*—Schwegman, Lundberg, Woessner and Kluth P.A.

(57) ABSTRACT

The present invention relates to a mobile crane boom having a self-sufficient energy supply arranged on it for supplying hydraulic energy to at least one hydraulic load arranged on the mobile crane boom. The supply of the hydraulic load arranged on the mobile crane boom is therefore not carried out by means of a hydraulic unit arranged on the revolving superstructure of the crane, which provides the hydraulic energy to each hydraulic load via hoses, but by means of a hydraulic unit which is arranged in the upper reaches of the mobile crane boom or in the area of the linkage of any second boom section. By arranging the hydraulic unit directly on the boom, the hoses normally required for supplying the hydraulic loads can be eliminated.

19 Claims, 7 Drawing Sheets

U.S. PATENT DOCUMENTS

| | | | | |
|---|---|---|---|---|
| 4,394,914 | A | 7/1983 | Privat | |
| 4,526,413 | A * | 7/1985 | Williams | 294/88 |
| 4,919,585 | A * | 4/1990 | Ruiz | 414/718 |
| 5,049,027 | A * | 9/1991 | Morrison et al. | 414/723 |
| 5,108,252 | A * | 4/1992 | Gilmore et al. | 414/694 |
| 5,360,313 | A * | 11/1994 | Gilmore et al. | 414/694 |
| 5,746,286 | A * | 5/1998 | Mlaker | 182/2.9 |
| 5,769,251 | A * | 6/1998 | Wada et al. | 212/289 |
| 6,021,825 | A * | 2/2000 | Bowling | 144/24.12 |
| 6,439,408 | B1 * | 8/2002 | Aquino et al. | 212/297 |
| 6,474,922 | B2 * | 11/2002 | Bachman et al. | 414/21 |
| 6,688,481 | B1 | 2/2004 | Adner et al. | 212/195 |

FOREIGN PATENT DOCUMENTS

| | | | |
|---|---|---|---|
| EP | 0 276 612 | | 8/1988 |
| EP | 0672612 | A1 | 9/1995 |
| EP | 1081088 | A1 | 3/2001 |
| EP | 1 126 086 | A1 * | 8/2001 |
| JP | 11-286395 | | 10/1999 |
| JP | 11286395 | A2 | 10/1999 |

* cited by examiner

MOBILE CRANE BOOM HAVING AN AUTARCHIC HYDRAULIC POWER UNIT MOUNTED THEREON

RELATED APPLICATION

This application claims priority under 35 U.S.C. 119(e) from U.S. Provisional Application Ser. No. 60/497,107 filed Aug. 22, 2003, which application is incorporated by reference and made a part hereof.

TECHNICAL FIELD

The present invention relates generally to a crane boom for a mobile crane and in particular to a mobile crane boom having arranged on it a self-sufficient energy supply for the generation of hydraulic energy serving to feed various hydraulic loads arranged on the mobile crane boom. Moreover, the present invention relates to a crane boom extension having a self-sufficient energy supply, and to a hydraulic supply of a hydraulic load arranged on a mobile crane boom.

BACKGROUND OF THE INVENTION

In the use of mobile telescopic cranes or mobile cranes with latticework booms, which in the present invention are collectively referred to as mobile cranes, there is frequently a need for supplying various devices on the main boom, or on an auxiliary boom attached to it, with hydraulic energy.

Usually, the hydraulic supply of all hydraulic loads arranged on a mobile crane is carried out using a single hydraulic pump arranged on the revolving superstructure and driven by a diesel engine also arranged on the revolving superstructure. With the aid of this very powerful hydraulic unit comprising the hydraulic pump and the diesel engine, all hydraulic loads arranged on the mobile crane are fed. Primarily, the hydraulic unit centrally arranged on the revolving superstructure serves to supply hydraulic energy to the pivoting apparatus also positioned on the revolving superstructure. Moreover, the telescopic sections extensible and retractable out of and into the base section are extended and retracted with the aid of the hydraulic unit centrally positioned on the revolving superstructure and with the aid of a hydraulically operable telescoping and locking apparatus arranged on the base section. For this purpose the locking and telescoping apparatus is linked with the hydraulic unit arranged on the revolving superstructure via hydraulic hoses which are wound on a hose drum.

Hydraulically pivotable main boom extensions are also operated with the hydraulic unit centrally arranged on the revolving superstructure. For this purpose, the pivoting cylinder necessary for pivoting the main boom extension up and down is centrally supplied with energy by the hydraulic unit arranged on the revolving superstructure via corresponding hydraulic hoses. In order to ensure secure guiding of the hydraulic hoses, the hoses are therefore wound on a driven or spring biased hose drum from which they are unwound during the telescoping action.

In addition, there is often a great number of additional hydraulic loads of the crane which are fed by the hydraulic unit. Principally, all hydraulic loads of the mobile crane are always fed through a star type hydraulic supply, wherein each individual hydraulic load is connected with the single hydraulic unit arranged on the revolving superstructure with an associated hydraulic line. This central hydraulic supply of the individual hydraulic loads is, however, very complex since each individual load is fed via separate hoses. This considerable technical complexity has had to be accepted, however, since solely the hydraulic unit on the revolving superstructure exists to supply the individual hydraulic loads.

As has been explained, this separate supply of the individual hydraulic loads is very complex and results in problems in particular with hydraulic loads at a great distance from the hydraulic unit due to very long hydraulic hoses. Since, due to the growing requirements on mobile cranes by the modern building industry, boom lengths are increasingly greater and longer, exceeding lengths of 100 meters, problems arise with the supply of piston-cylinder units, for example, those situated at the head of the main boom.

The supply of these hydraulic loads can no longer be economically or technically implemented with the arrangement described, since due to their great own weight as a consequence of the great main boom lengths the hydraulic hoses are so heavy that they tend to break at great heights. While the dimensions of the hoses and in particular their wall thicknesses and their diameters may be extended to a certain degree, this measure is limited by the maximum allowable winding volume.

Another problem arising with the supply of piston-cylinder units at a great height by means of a hydraulic unit centrally arranged on the revolving superstructure is that as a consequence of the hose length to be maintained wound up, for example, on the crane revolving superstructure, the hose is very heavy. The arrangement of very heavy components such as these very heavy hose drums is undesirable because of the maximum allowable axle load of 12 tons in Germany and because of the space needed by the large hose drum.

Indeed, it is known from EP 0 276 612 A1 or from JP 11286395 to provide a working platform being mounted to a telescopic arm with an autarchic hydraulic power unit which is adapted to maintain the working platform in its horizontal position by actuating hydraulic piston cylinder units. However, the arrangement of such a hydraulic power unit on a working platform which is always leveled in its horizontal position comprises the special characteristic, that the hydraulic power unit does only work accurately, when the working platform is really always leveled in its horizontal position. In the event of tilting of the working platform, the hydraulic power unit will tilt together with the working platform which in turn results already in the event of slight deflections from the horizontal position in that the hydraulic pump of the hydraulic power unit will run dry which will in turn result in a malfunction of the hydraulic power unit.

SUMMARY OF THE INVENTION

To solve the above described problems in the supply of a piston-cylinder unit arranged on a crane boom centrally supplied by a hydraulic unit arranged, for example, on the revolving superstructure of a mobile crane, according to a first aspect of the present invention, a mobile crane boom is provided having a self-sufficient hydraulic unit arranged on it for supplying at least one hydraulic load arranged on the crane boom with hydraulic energy.

According to an exemplary embodiment of the present invention, the hydraulic unit is arranged above the first third of the length of the boom—as measured from the pivoting point of the boom on the revolving superstructure. In particular it has been found to be advantageous to arrange the hydraulic unit in the upper half of the boom, while an arrangement in the top third is deemed to be particularly advantageous. If the boom is a telescopic boom, the collar of each telescopic section has been found to be particularly advantageous for the arrangement of the hydraulic unit in the above-mentioned exemplary arrangement areas. Of course, the hydraulic unit can also be arranged at any position within the telescopic sections.

According to another exemplary embodiment of the present invention, a mobile crane boom is provided having a first boom section comprising a main boom and a self-sufficient hydraulic unit suitable to provide hydraulic energy to at least one hydraulic load arranged on the crane boom. According to the present invention, the hydraulic unit is arranged either at the head of the first boom section or on a second boom section to be attached to the former.

The hydraulic load to be arranged either at the head of the first boom section or on a second boom section attached to it, can be, for example, a piston-cylinder unit, suitable, for example, to pivot up and down the second boom section pivotably arranged on the first boom section.

The invention is therefore based on the idea of ensuring the supply of the hydraulic loads arranged on the mobile crane boom not by means of a hydraulic unit centrally arranged, for example, on the revolving superstructure of the crane which provides each hydraulic load with hydraulic energy via hoses, but to ensure the supply of the hydraulic load by means of a decentrally arranged hydraulic unit which is arranged near each hydraulic load, in particular in the upper reaches of the mobile boom or in the area of the pivot joint of any second boom section, and therefore near the piston-cylinder units to be supplied there.

The section of the mobile crane boom referred to here as the first boom section can be, for example, a telescoping main boom of a telescopic crane or else the main boom of a mobile crane having a latticework boom, wherein each first boom section, i.e. the telescoping main boom or the latticework boom, may, of course, be extended with at least one intermediary portion. At the free end of this at least one intermediary portion, a second boom section may in turn be arranged, which is pivotable with the aid of a hydraulic unit arranged on the first or on the second boom section.

By arranging a hydraulic unit for hydraulic supply near a hydraulic load, such as a piston-cylinder unit, situated at a great height to supply the same, the hydraulic supply lines, hitherto deemed problematical, are eliminated, which would otherwise be necessary between the hydraulic load at a great height and the hydraulic unit centrally arranged, for example, on the revolving superstructure. By arranging a hydraulic unit at a great height, as suggested here, these lines may be eliminated, so that a self-sufficient energy supply for feeding a piston-cylinder unit or any hydraulic load such as a hydraulic motor is provided. There is only an electrical connection between the hydraulic unit and the crane superstructure, such as a bus connection to control the hydraulic unit. Instead of the already mentioned bus connection, it is of course also possible to control the hydraulic unit via a radio link.

The hydraulic unit itself can be, for example, a hydraulic pump driven by an internal combustion engine such as a diesel engine, while for operating the hydraulic pump, an electric motor could also be used, which would, however, necessitate another cable connection to the revolving superstructure.

As described above, the present invention is intended to create, among other things, a possibility to supply hydraulic energy to a piston-cylinder unit arranged at a great height of a mobile crane in order to pivot a main boom extension up and down, without the well known problems arising with hydraulic lines extending between the piston-cylinder unit and a hydraulic unit arranged, for example, on the revolving superstructure of a crane.

It is of course possible to supply hydraulic energy to other hydraulic loads arranged in the area of the hydraulic unit with the aid of the self-sufficient energy supply suggested here. A pulley arranged on the main boom or on the main boom extension, which becomes necessary as a consequence of the cable guiding when the main boom extension is pivoted down, may be folded up and down with the aid of the hydraulic unit.

It is also possible to carry out bolting of the main boom extension of the main boom. For this purpose bolting cylinders are provided, for example, at the foot of the main boom extension which may de activated or deactivated with the aid of the hydraulic unit, in order to release or establish a bolting connection between the main boom extension and the main boom.

According to another exemplary embodiment of the present invention, the hydraulic unit is arranged on the second boom section, such as a pivotable main boom extension. If between the head of the main boom and a main boom extension one or more intermediate sections are interposed, the arrangement of the hydraulic unit on the second boom section is advantageous in that at the highest point of the first boom section, which in this case ends in the head of the last intermediate portion, there is always a self-sufficient energy supply. The hydraulic unit therefore does not have to be first removed from the head of the main boom and then remounted on one of the intermediary potions, but is always in the desired position due to its arrangement on the main boom extension.

In order to ensure smooth operation of the hydraulic unit arranged on the main boom extension during pivoting up and down of the same, the hydraulic unit is rotatably supported about at least one axis, so that during the whole of the pivoting operation, it is maintained in essentially the same position with respect to the ground. Therefore, since the hydraulic power unit is due to its pivotally arrangement always in its ideal operating position, dry running of the pump of the hydraulic power unit can be avoided, a problem which was already discussed as being problematical at the beginning of the present application.

According to another aspect of the present invention, a hydraulically operable main boom extension is suggested having a self-sufficient energy supply, such as a hydraulic unit. The main boom extension according to the present invention having a hydraulic unit arranged on it, is advantageous in that, when the main boom extension has its own energy supply, additional energy supply lines need not extend from the revolving superstructure of a crane to the main boom extension. The elimination of these supply lines, which would otherwise have to be provided, is advantageous in particular when the main boom extension is not directly arranged on the main boom of a crane, but when between the main boom extension and the main boom one or more intermediate portions are interposed. The hydraulic lines, which otherwise have to be provided in the area of the intermediate portions, can be eliminated which facilitate faster rigging of the crane.

Moreover, such a main boom extension with its own self-sufficient energy supply is much more versatile and can be brought more quickly into an operable state since for operating the main boom extension, i.e. for pivoting it up and down, additional lines for hydraulic supply need not be provided. As a consequence, the main boom extension according to the present invention may be quickly mounted on any main boom without intermediary portions arranged on it, and may be directly pivoted up and down without the provision of additional hydraulic lines.

SHORT DESCRIPTION OF THE DRAWINGS

In order to provide a better understanding and for further explanation, an exemplary embodiment of the present invention will be described in the following with reference to the accompanying drawings, in which.

Figure 5A:
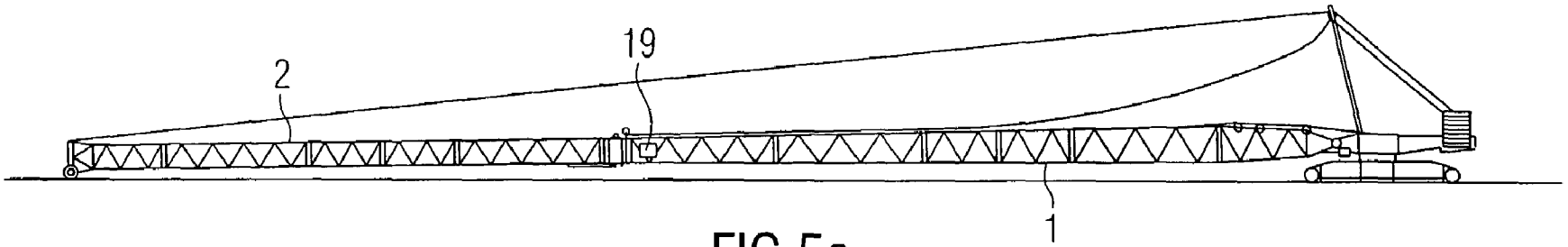
Figure 5B:
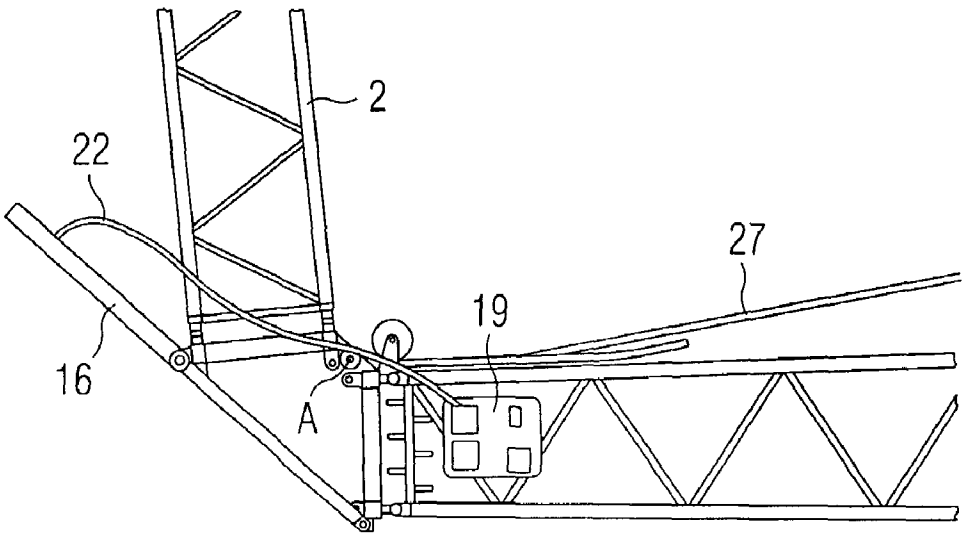

FIG. 5*a* is a view of a mobile crawler-type crane having a bipartite latticework boom;

FIG. 5*b* is a detailed view of the coupling area of the two lattice boom sections of FIG. 5*a;*

Figure 5C:
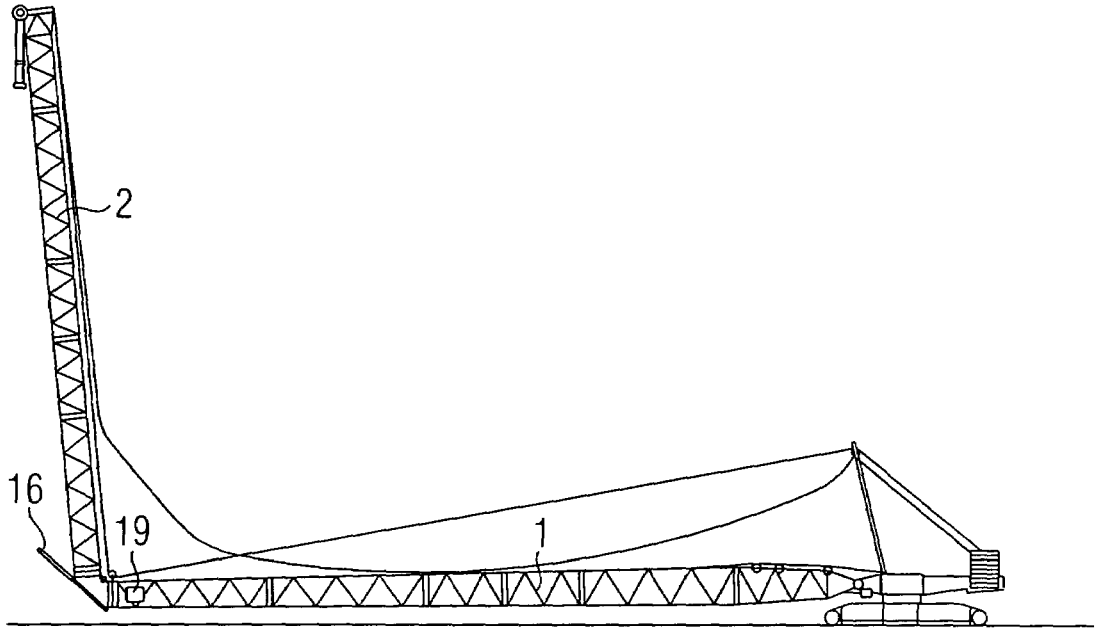
Figure 5D:
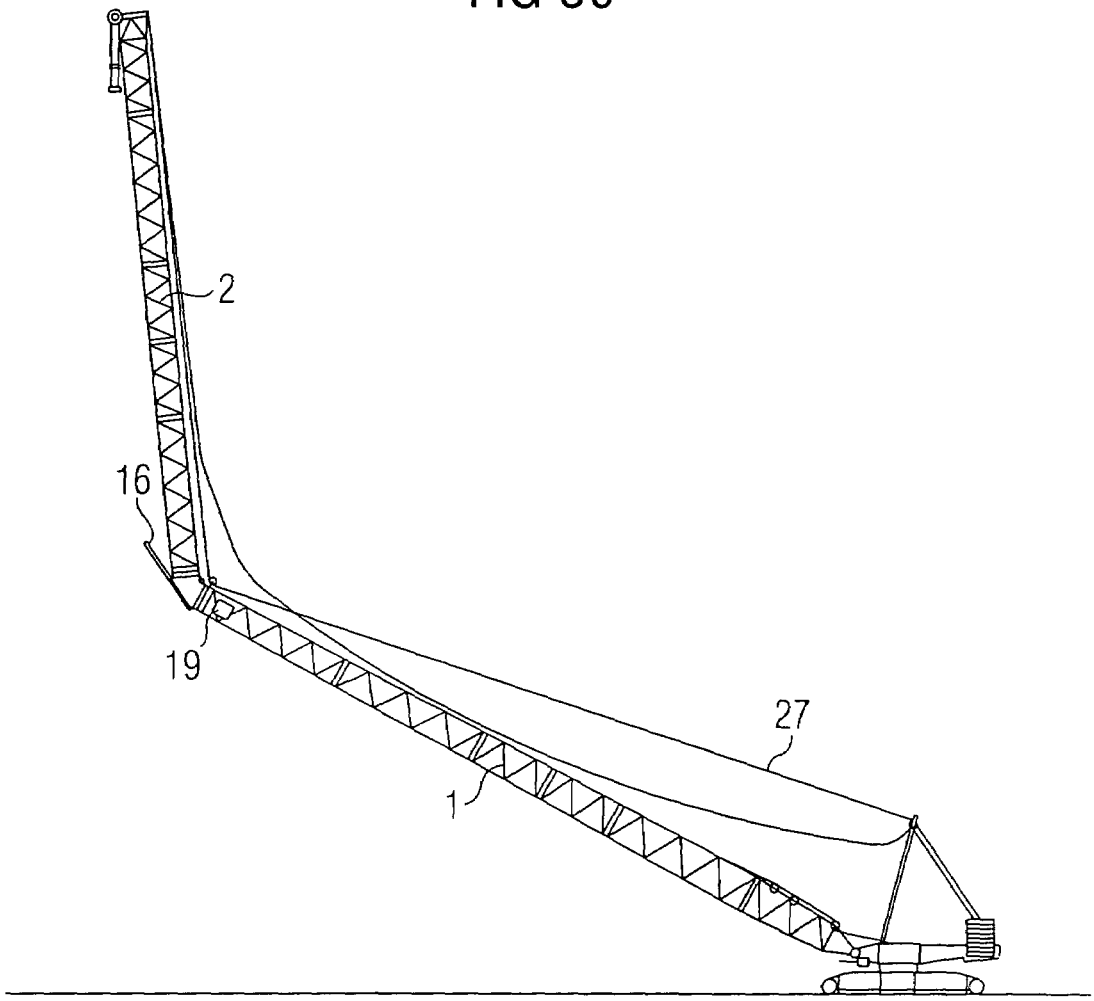

FIGS. 5*c*, 5*d* are further views of the mobile crawler-type crane of FIG. 5*a;*

Figure 6:
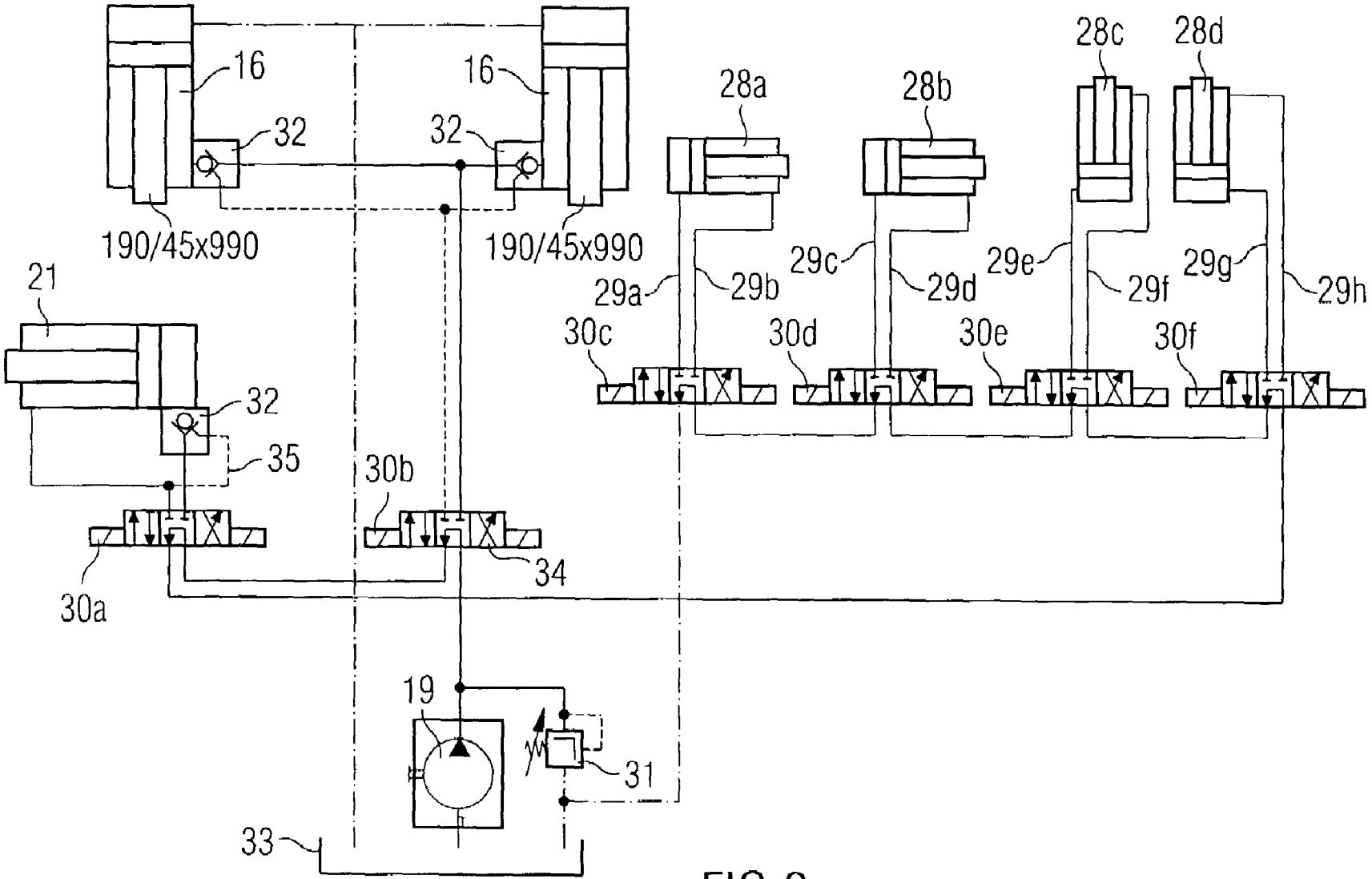

FIG. 6 shows a schematic diagram of the hydraulic supply.

Throughout the drawing figures, corresponding parts are designated with the same reference numerals.

DESCRIPTION OF THE EXEMPLARY EMBODIMENTS OF THE INVENTION

Figure 1:
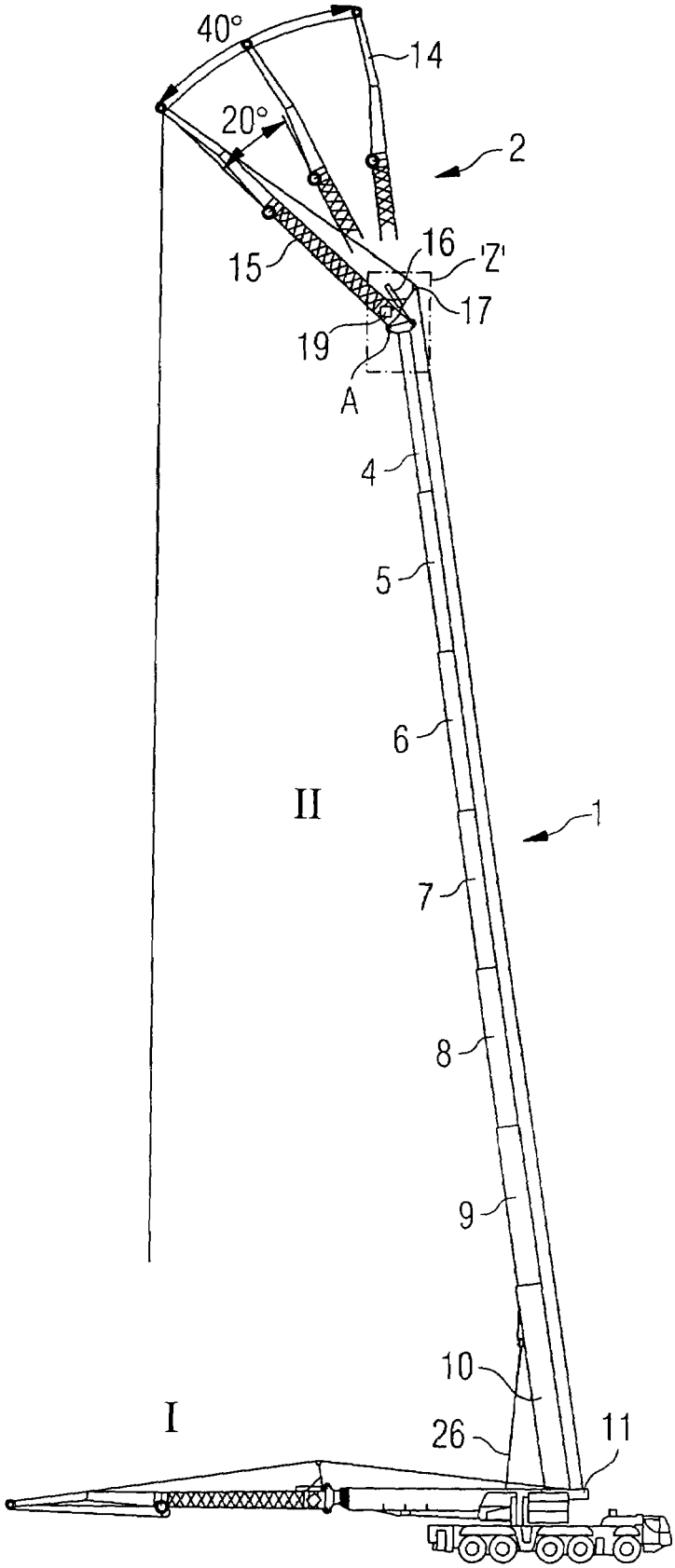
FIG. 1 is a view of a telescopic crane, wherein the crane boom is shown in a lowered and erected position.

FIG. 1 shows a mobile crane, wherein a luffing boom 1, 2 of the mobile crane is shown in two different positions: in a first, lowered position I and in a second position II erected with the help of a piston-cylinder unit 26. In the erected position 11 the telescoping main boom I is in its completely telescopically extended state. Main boom 1 consists of a base section 10 and six more telescopic sections 5 through 9 telescopically extendable and retractable therein. To standardize the terminology used in the context of the present application, the main boom formed by base section 10 and telescopic sections 4 to 9 is also referred to as first boom section 1, wherein first boom section 1 may, however, also be the main boom of a latticework boom crane, as will be described below.

As can be seen from FIG. 1, a main boom extension 2 is linked to the first boom section. Main boom extension 2 comprises a first box tip 14 and a latticework boom 15 linked at its foot to the head of first boom section 1. To standardize the terminology used in the following, main boom extension 2, comprising box tip 14 and latticework boom 15 is also referred to as second boom section 2. As a modification of the exemplary embodiment shown here, second boom extension 2 can of course comprise, for example, only latticework boom 15. Instead of a box tip 2, a lattice mast tip could, of course, also be used.

As can be further derived from FIG. 1, second boom section 2 is pivotable in the pivoting plane about linkage point A. In order to ensure secure cable guiding of lifting cable 18 in the pivoted-down position of the second boom section, the cable is guided from the revolving superstructure 11 of the mobile crane via a pulley 17 which can be hydraulically hinged up and down, up to the tip of second boom section 2. In the extended position of the second boom section, this pulley 17 can be eliminated, since in the extended position, cable 18 extends in a straight line from revolving superstructure 11 to the tip of the second boom section, without the need for deflection points. In the extended position of second boom section 2, pulley 17 can therefore be folded against boom 1, 2.

Figure 2:
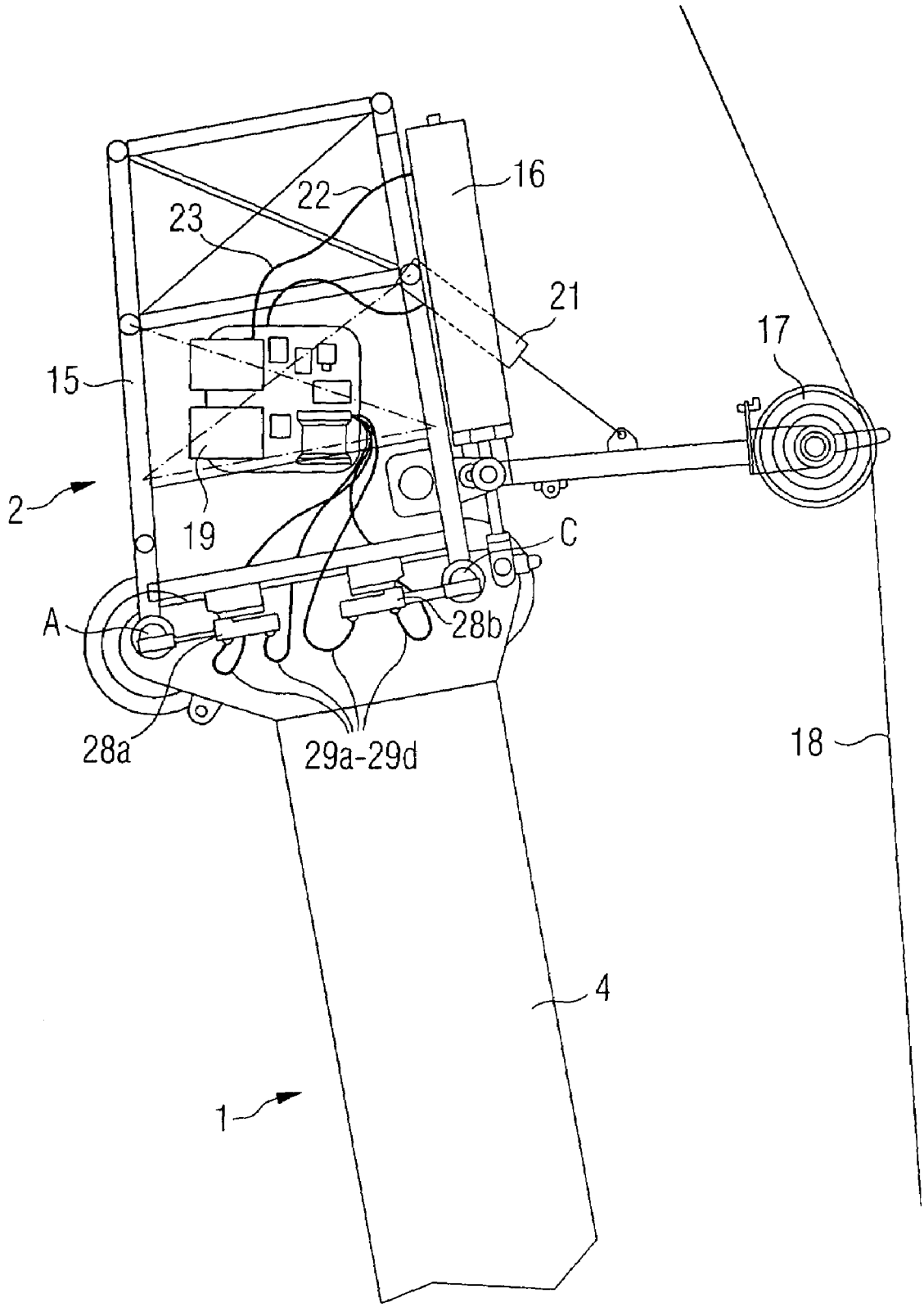
FIG. 2 is a detailed view of the detail designated Z of FIG. 1.

FIG. 2 shows the detail designated "Z" of FIG. 1 in the area of the linkage between second boom section 2 and the head of the first boom section. As can be seen from FIG. 2, latticework boom 15 of second boom section 2 is linked at the head of the first boom section at position "A" in a pivoting manner with the aid of a hydraulically operable bolting cylinder 28*a*. The person of skill in the art will recognize, of course, that when bolting at position A is discussed, latticework boom 15 is connected at a second position with the head of the first boom section, which is in the depth of the drawing plane symmetrical to the pivoting plane of the boom. The two boltings may, for example, be in the extensions of the two bottom chords at the foot of the second boom section. With this bolting, second boom section 2 is pivotable about axis A, which is defined by the two bolting positions. To fix second boom section 2 on first boom section 1, the two boom sections 1, 2 can also be bolted at position C with a hydraulically operable bolting cylinder 28*b*.

According to the present invention, hydraulic unit 19 is arranged within latticework boom 15. As has become obvious from the preceding general description of the invention, hydraulic unit 19 can, of course, also be arranged on first boom section 1, in particular on the head of the innermost telescopic section. Another space-saving possibility to arrange hydraulic unit 19, could be, for example, to position unit 19 within innermost telescopic section 4. In order to always maintain the functionality of hydraulic unit 19 in any position of second boom section 2, hydraulic unit 19 is rotatably supported about axis "B". Hydraulic unit 19 can be a diesel unit with an associated hydraulic pump, wherein an electric motor could also be used instead of a diesel engine. As can be derived from FIG. 2, hydraulic unit 19 is connected with two piston-cylinder units 16 via a hydraulic line 22, wherein due to the illustrated view of the arrangement shown here, only one piston-cylinder unit 16 can be seen. For convenience, the second hydraulic line, which is necessary to move piston-cylinder unit in the reverse direction, is not shown.

The head of first boom section 1 is kinematically coupled with the foot of second boom section 2 or the foot of latticework boom 15 via the two piston-cylinder units 16. In the exemplary embodiment of the present invention shown here, the cylinder of each piston-cylinder unit 16 is pivotably linked to the top side of latticework boom 15 and each associated cylinder at the head of first boom section 1.

On the top side of latticework boom 15, a pulley 17 is also arranged which, with another piston-cylinder unit 21 may be folded against the top side of latticework boom 15 by the operation of hydraulic unit 19.

Figure 3:
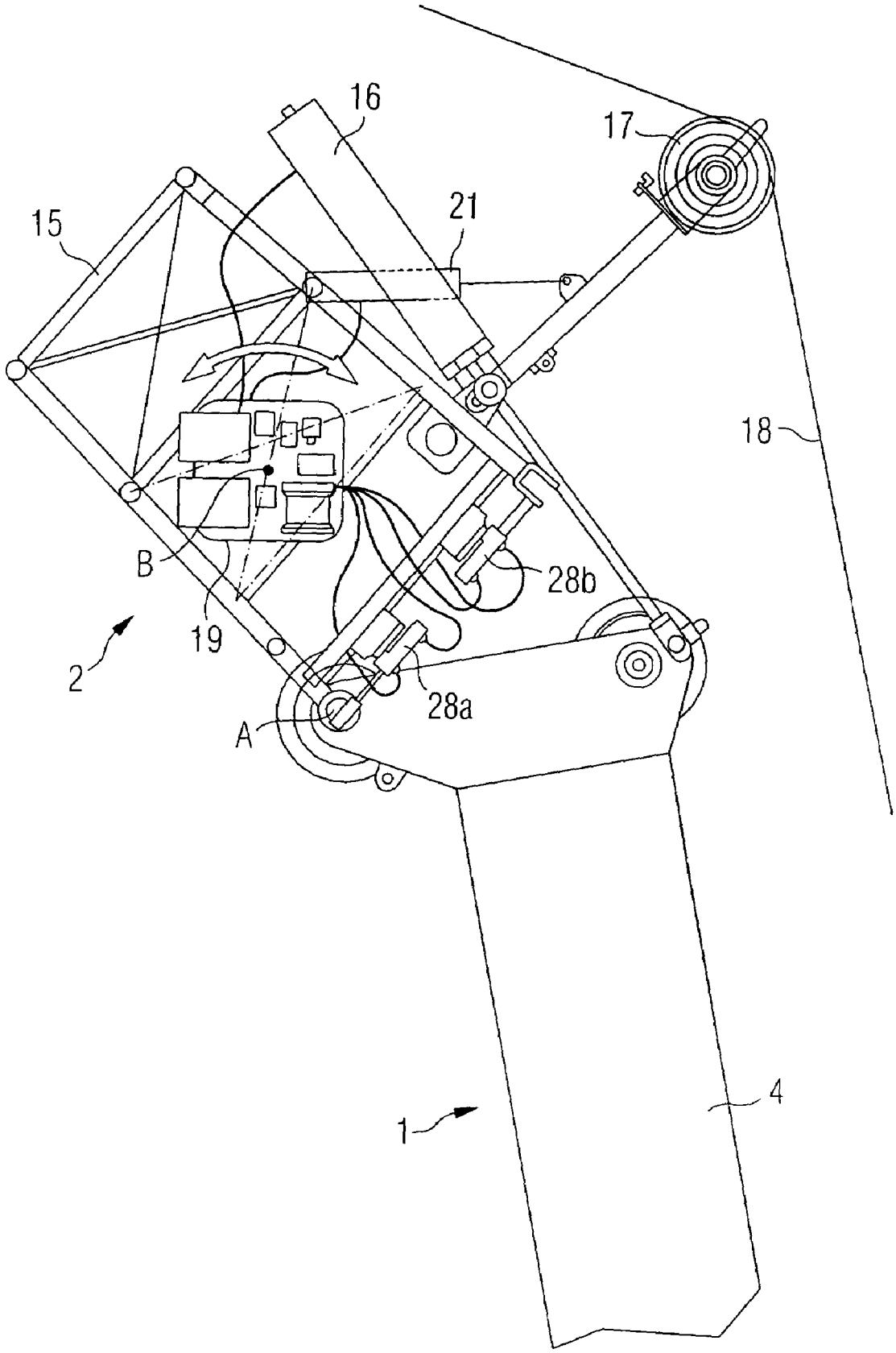
FIG. 3 is a further detailed view of the detail Z of FIG. 1.

As initially explained in the present invention, hydraulic unit 19 primarily serves to operate first piston-cylinder units 16 in order to pivot downward second boom section 2 by extending piston-cylinder units 16, as shown in FIG. 3. Second piston-cylinder unit 21 can also be operated with the aid of hydraulic unit 19 via hydraulic line 23 to either fold foldable pulley 17 against second boom section 2 or to hinge it away from the latter. For convenience, the second hydraulic line necessary to move the piston-cylinder unit in the reverse direction has also been omitted.

As initially explained in the description of FIG. 2, first boom section 1 is joined to second boom section 2 via hydraulically operable bolting cylinders 28*a*, 28*b*. The supply of bolting cylinders 28*a*, 28*b* is also effected by hydraulic unit 19, providing the necessary hydraulic energy to each bolting cylinder via corresponding hydraulic hoses 29*a* to 29*d*. Apart from the already described possibility of pivoting the two boom sections 1, 2 in the pivoting plane by means of bolting the bolting cylinders 28*a* arranged symmetrically about the pivoting plane and activating the first piston-cylinder unit, second boom section 2 can, of course, also be pivoted out of the pivoting plane. To do this, only bolting cylinders 28*a*, 28*b*, which are in the drawing plane, are extended by means of hydraulic unit 19, so that the first and the second boom section are bolted to one another in axis A-C. Axis A-C therefore forms a rotary axis for the second boom section, about which it can be hinged with respect to the first boom section. This hingeability can be advantageous, for example, to fold the second boom section against the first boom section for transport.

Detail "Z" is shown again in FIG. 3, wherein second boom section 2 has been, however, pivoted down with the aid of hydraulic unit 19 and the two associated piston-cylinder units 16. As can be seen more clearly, the piston of first piston-cylinder unit 16 is linked to the head of first boom section 1, and the associated cylinder is linked at the foot area of second boom section 2, where the reverse arrangement would also be possible, of course. It can also be seen very clearly how hydraulic unit 19 can rotate about axis B, which is indicated by the double arrow. It can also be seen from FIG. 3 that to pivot down second boom section 2, only bolting cylinders 28*a* are extended, establishing a hinged bolting of second boom section 2 in axis A, so that second boom section 2 can be pivoted down by operating piston-cylinder unit 16 with the hydraulic unit.

Figure 4:
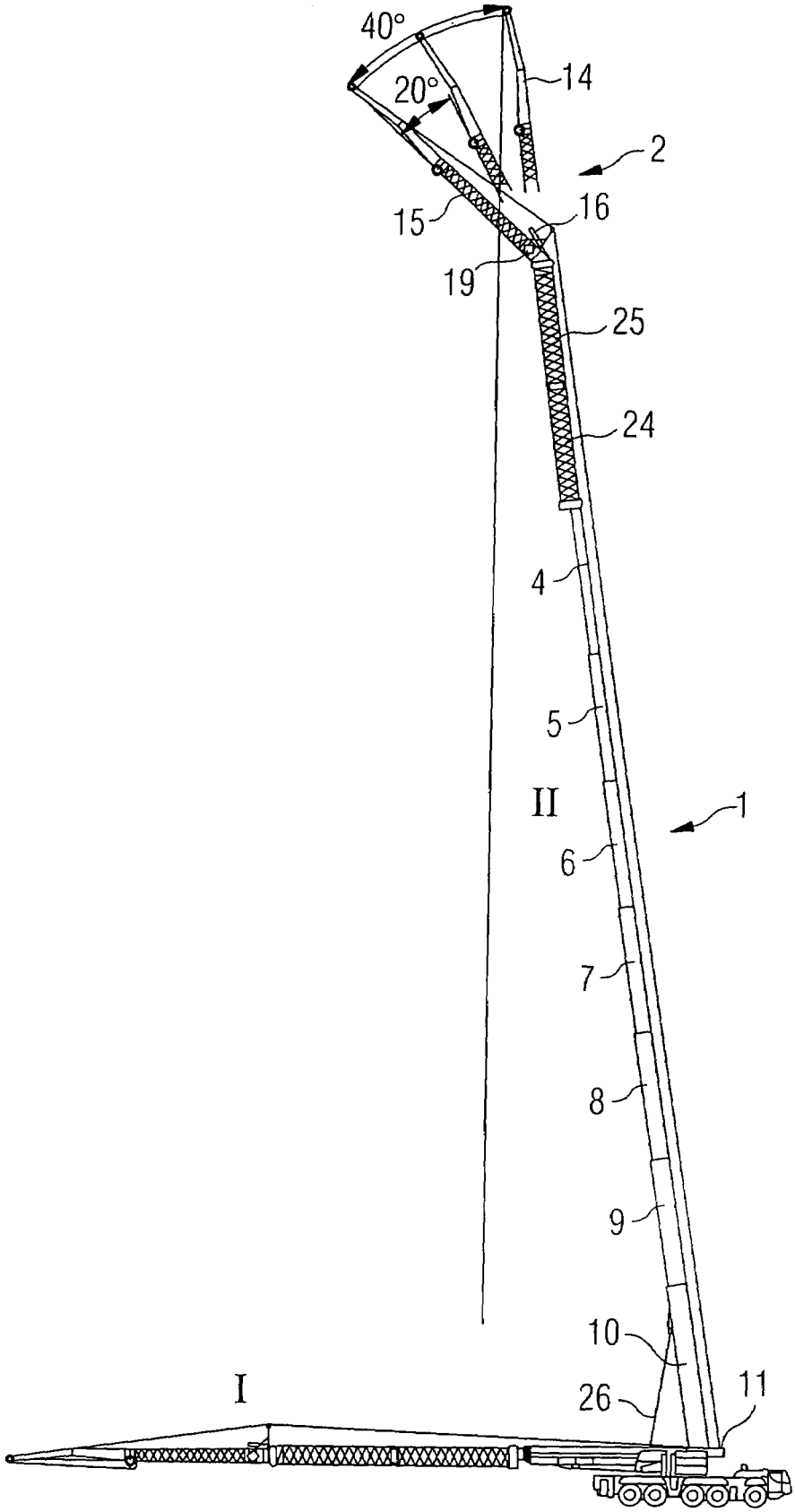
FIG. 4 is a view of the telescopic crane corresponding to FIG. 1 with two intermediate portions interposed between the main boom extension and the main boom.

FIG. 4 shows a mobile crane essentially corresponding to the mobile crane shown in FIG. 1, wherein, however, at the head of innermost telescopic section 4, two intermediate portions 24, 25, bolted to each other, are mounted via bolt connections. Intermediate portions 24, 25 are two auxiliary boom portions made in a latticework construction, which, however, could also be made in a box construction. At the head of the second intermediary portion 25, a main boom extension 2 is linked in an analogous fashion to the one in FIG. 1. The main boom extension 2, again, comprises a first box tip 14 and a latticework boom 15, pivotably linked at its foot to the head of first boom section 1, which ends at the head of second intermediary portion 25.

As schematically shown in FIG. 4, a hydraulic unit 19 is inventively arranged in the area of the linkage of the second boom section supplying hydraulic energy to a first piston-cylinder unit 16 arranged between the head of first boom section 1 and the foot of second boom section 2. As may be further seen from FIG. 4, by operating hydraulic unit 19, again, second boom section 2 may be pivoted about axis A. While, in analogy to FIGS. 1 to 3, the hydraulic unit is again shown as arranged on the second boom section, hydraulic unit 19 can, of course, also be arranged at the end of first boom section 2, i.e., for example, at the head of second intermediate portion 25.

The arrangement of hydraulic unit 19 on second boom section 2 is, however, advantageous in that the rigging complexity can be reduced when the mobile crane shown in FIG. 1 is to be converted into the one shown in FIG. 2 by the insertion of two intermediate portions 24, 25. If hydraulic unit 19 is arranged on the second boom section, all that is necessary for re-rigging is to remove the second boom section including the piston-cylinder unit 16, to mount the intermediate portions 24, 25 and then to re-mount the second boom section, including the piston-cylinder unit 16. Separate dismantling of the hydraulic unit 19 from the head of the innermost telescopic section and subsequent reinsertion at the head of second intermediate portion 25, can thus be eliminated.

FIGS. 5*a* to 5*d* show various positions of a crawler-type crane having a bipartite latticework boom 1, 2 whose two boom sections 1, 2 are kinematically coupled with the aid of a hydraulic unit 19 and a piston-cylinder unit 16. In FIG. 5*a*, the whole of the bipartite latticework boom of the crawler-type crane is in a lowered position on the ground. For erecting the entire latticework boom 1, 2 of the crawler-type crane, as shown in FIG. 5*c*, second boom section 2 is first erected by operating the piston-cylinder unit with hydraulic unit 19. As can be seen from FIG. 5*c*, and even better from FIG. 5*b*, the second boom section 2 is again bolted in an axis A at the top chord of the two boom sections 1, 2 in a hinged fashion.

Between the two bottom chords of the two boom sections 1, 2, a first piston-cylinder unit 16 is arranged, whose piston is linked to the first boom section and whose associated cylinder is linked to the second boom section. According to the present invention, as can be seen from FIG. 5*b*, a hydraulic unit 19 suitable for feeding first piston-cylinder unit 16 with hydraulic energy is mounted at the head of the first boom section in a hinged fashion. While in FIG. 5*b* hydraulic unit 19 is shown arranged on the first boom section, hydraulic unit 19 can, of course, also be arranged at the foot of the second boom section. This would be even more advantageous in the present case, since the length of hydraulic hose 22 for feeding piston-cylinder unit 16 of piston-cylinder unit 16 could be shorter.

As can be seen in FIG. 5*c*, second boom section 2 was moved with the aid of the hydraulic unit 19 and piston-cylinder unit 16 from the position on the ground as shown in FIG. 5*a* to the almost vertical position shown here. In order to bring the entire latticework boom 1, 2 into its operative position, first boom section 1 is erected via neck cable 27, as can be seen from FIG. 5*d*. At the same time, the second boom section 2 is lowered with respect to first boom section 1 by means of the operation of hydraulic unit 19 and therefore piston-cylinder unit 16, so that in its final position, the head of first boom section 1 can ultimately be bolted to second boom section 2. For bolting the two boom sections 1, 2, hydraulic unit 19 may again be used to operate the corresponding bolting cylinders for bolting the two boom sections 1, 2.

FIG. 6 shows as an example a possible hydraulic system schematically reflecting the supply of hydraulic loads 16, 19, 28*a* to 28*d*. The hydraulic system shown has a neutral bypass, which means that hydraulic unit 19, in an unoperated position of valves 30 and 34, delivers the hydraulic fluid almost without pressure to reservoir 33. If, however, one of valves 30 or 34 is operated, the connection with reservoir 33 is interrupted, so that, depending on the switching position of valves 30, 34, the bottom and top sides of the cylinder of piston-cylinder loads 16, 21 or 28*a*-28*d* are supplied with hydraulic liquid. The pressure build-up depends on the load of each load 16, 21 or 28. The maximum pressure build-up is, however, not greater than the pressure adjusted by pressure-limiting valve 31.

Hydraulic loads 16, 21 are equipped with load holding valves serving to secure the position of hydraulic load 16, 21, even if the system has been shut down or a line has been broken. The load holding valves 32 are hydraulically releasable, which can be done by direct driving via valve 34 or by a separate control oil line 35.

In the present hydraulic system, only one hydraulic load can be driven at the same time. The hydraulic system shown can be modified, of course, so that a plurality of hydraulic loads can be operated simultaneously.

As an alternative to the hydraulic system shown here, numerous other common control approaches may be used, such as constant pressure systems with DBV or constant-flow systems with a pressure regulator or adjustable pumps. Combinations of the above-mentioned systems are also possible. Moreover, there are various alternatives for the load holding valves 32, such as valves having a tight seat, or dampened lowering valves. Nor is it always necessary to drive each load using a separate switching valve 30. There are a great number of variants also for valves 30, 34 with respect to the switching segments and their driving and resetting.

FIG. 6 only shows one possibility for a hydraulic system, wherein for greater convenience, the usual comfort and safety package, such as variable throttles or filters are not shown, which the person skilled in the art will, however, know how to implement.

The invention claimed is:

1. A mobile crane comprising:

a mobile carrier;

a superstructure rotatably coupled to the mobile carrier;

a luffing boom connected to the superstructure, the luffing boom including a first boom section and a second boom section, the second boom section being kinematically coupled with said first boom section via a first piston-cylinder unit and being pivoted in a pivoting plane by means of said first piston-cylinder unit, wherein the first boom section comprises a main boom, and wherein said main boom includes at least one of a telescopic and a latticework boom for a mobile crane; and a self-sufficient hydraulic unit arranged either at a head of said first boom section or at the second boom section being kinematically coupled with the first boom section to supply hydraulic energy to at least the first piston cylinder, wherein said hydraulic unit is supported so that it may be rotated about at least one axis to maintain an essentially same pivotable position with respect to ground in any position of the luffing boom.

2. The mobile crane of claim 1, wherein said first piston-cylinder unit is arranged between the head of said first boom section and a foot of said second boom section.

3. The mobile crane of claim 1, wherein said second boom section is a main boom extension.

4. The mobile crane of claim 1, wherein said first boom section comprises at least one intermediate portion arranged between said second boom section and said main boom.

5. The mobile crane of claim 1, wherein said hydraulic unit is a self-sufficient energy supply unit which does not comprise any hydraulic supply hoses from the first boom section.

6. The mobile crane of claim 1, wherein said hydraulic unit is operated by an internal combustion engine.

7. The mobile crane of claim 1, wherein said hydraulic unit is a diesel unit.

8. The mobile crane of claim 1, wherein said hydraulic unit supplies other hydraulic loads arranged on said crane boom.

9. The mobile crane of claim 1, wherein said first boom section is connected to said second boom section by hydraulically operable boltings which are operated by means of said hydraulic unit.

10. The mobile crane of claim 1, wherein, at said first boom section or at said second boom section, a pulley foldable up and down by means of a second piston-cylinder unit is arranged for guiding a lifting cable, wherein said piston-cylinder unit is operated for moving said pulley with the aid of the hydraulic unit.

11. The mobile crane of claim 1, wherein said second boom section can be pivoted vertically to the pivoting plane with a second piston-cylinder unit by operating said hydraulic unit.

12. The mobile crane of claim 1, wherein the first boom section includes at least one luffable boom subsection.

13. The mobile crane of claim 12, wherein the self-sufficient hydraulic unit is maintained at essentially a same pivotable position with respect to ground in any operating position of the luffing boom.

14. The mobile crane of claim 13, wherein the self-sufficient hydraulic unit is operable with the first boom section being in a non-vertical position.

15. A mobile crane comprising:

a mobile carrier;

a superstructure movably connected to the mobile carrier;

a luffing telescopic or latticework boom connected to the superstructure, the luffing boom including a first, luffable boom section and a second, luffable boom section, the second boom section being kinematically coupled with said first boom section via a first piston-cylinder unit and being pivoted in a pivoting plane by means of said first piston-cylinder unit;

a self-sufficient hydraulic unit arranged either at a head of said first boom section or at the second boom section being kinematically coupled with the first boom section to supply hydraulic energy to at least the first piston cylinder; and means for preventing dry running of the hydraulic unit in operating positions of luffing boom, such that the self-sufficient hydraulic unit is maintained at essentially a same pivotable position with respect to ground in any operating position of the luffing boom.

16. The mobile crane of claim 15, wherein the self-sufficient hydraulic unit is operable with the first boom section being in a non-vertical position.

17. A mobile crane comprising:

a mobile carrier;

a superstructure rotationally connected to the mobile carrier;

a luffing telescopic or latticework boom connected to the superstructure, the luffing boom including a top end;

a self-sufficient hydraulic unit arranged at the top end to supply hydraulic energy to a hydraulic load on the luffing boom, wherein the self-sufficient hydraulic unit is maintained at essentially a same pivotable position with respect to ground in any operating position of the luffing boom.

18. The mobile crane of claim 17, wherein the self-sufficient hydraulic unit includes means for preventing dry running of the hydraulic unit in operating positions of luffing boom.

19. The mobile crane of claim 17, wherein the luffing boom is luffable with respect to the superstructure.

* * * * *